US008660474B2

(12) United States Patent
Seto et al.

(10) Patent No.: US 8,660,474 B2
(45) Date of Patent: Feb. 25, 2014

(54) IMAGE FORMING APPARATUS HAVING FIXING DEVICE WITH AIR NOZZLE FOR SEPARATING SHEET

(75) Inventors: Takashi Seto, Kanagawa (JP); Takeshi Yamamoto, Kanagawa (JP); Fumihiro Hirose, Kanagawa (JP); Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 237 days.

(21) Appl. No.: 13/067,809

(22) Filed: Jun. 28, 2011

(65) Prior Publication Data

US 2012/0014725 A1 Jan. 19, 2012

(30) Foreign Application Priority Data

Jul. 16, 2010 (JP) ..... 2010-161473
Sep. 16, 2010 (JP) ..... 2010-207481

(51) Int. Cl.
*G03G 15/20* (2006.01)

(52) U.S. Cl.
USPC ..... 399/323; 399/122

(58) Field of Classification Search
USPC ..... 399/122, 323, 398; 271/309, 900
See application file for complete search history.

(56) References Cited

U.S. PATENT DOCUMENTS 3,704,881 A * 12/1972 Suda ..... 271/309
3,955,813 A 5/1976 Edwards
4,168,830 A * 9/1979 Hori et al. ..... 271/176
6,131,009 A 10/2000 Hasegawa
6,496,666 B2 12/2002 Hayashi et al.
6,591,081 B2 7/2003 Hasegawa
7,062,211 B2 * 6/2006 Baba et al. ..... 399/323
7,070,182 B2 7/2006 Hasegawa
7,505,723 B2 * 3/2009 Roof ..... 399/323
7,515,850 B2 4/2009 Hasegawa
7,551,882 B2 6/2009 Seto et al.
7,630,652 B2 12/2009 Hasegawa
7,711,300 B2 5/2010 Nakafuji et al.
7,747,205 B2 * 6/2010 Fujii ..... 399/323
7,831,185 B2 11/2010 Masubuchi et al.
7,925,177 B2 4/2011 Ishii et al.

(Continued)

FOREIGN PATENT DOCUMENTS

JP 51-104350 A 9/1976
JP 60247672 A * 12/1985

(Continued)

OTHER PUBLICATIONS

English language abstract for patent publication No. JP-02-218360 (which corresponds to JP-2876127-B2).

(Continued)

*Primary Examiner* — Robert Beatty
(74) *Attorney, Agent, or Firm* — Harness, Dickey & Pierce, P.L.C.

(57) ABSTRACT

An image forming apparatus including a fixing device to fix a toner image on a recoding medium; a compressed air generator to generate a compressed air; an air nozzle to inject the compressed air to separate the recording medium having the fixed toner image from the fixing device; a first switching unit to switch the air nozzle between injection and termination, which is provided upstream from the air nozzle; and a buffer unit to retain the compressed air, which is provided upstream from the air nozzle and downstream from the first switching unit.

19 Claims, 12 Drawing Sheets

(56) References Cited

U.S. PATENT DOCUMENTS

| | | | | |
|---|---|---|---|---|
| 8,320,807 | B2 * | 11/2012 | Onodera et al. | 399/323 |
| 8,433,230 | B2 * | 4/2013 | Seto et al. | 399/323 |
| 2002/0009306 | A1 | 1/2002 | Hayashi et al. | |
| 2002/0044805 | A1 | 4/2002 | Hasegawa | |
| 2004/0178573 | A1 | 9/2004 | Hasegawa | |
| 2006/0029411 | A1 | 2/2006 | Ishii et al. | |
| 2006/0257183 | A1 | 11/2006 | Ehara et al. | |
| 2007/0008395 | A1 | 1/2007 | Masubuchi et al. | |
| 2007/0014600 | A1 | 1/2007 | Ishii et al. | |
| 2007/0077104 | A1 | 4/2007 | Hasegawa | |
| 2007/0206981 | A1 * | 9/2007 | Amico et al. | 399/323 |
| 2008/0008505 | A1 | 1/2008 | Seto et al. | |
| 2008/0069610 | A1 | 3/2008 | Nakafuji et al. | |
| 2008/0310862 | A1 | 12/2008 | Hasegawa | |
| 2009/0297199 | A1 | 12/2009 | Yamashina et al. | |
| 2010/0014903 | A1 | 1/2010 | Seto et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0232844 | A1 | 9/2010 | Saito et al. | |
| 2010/0239292 | A1 | 9/2010 | Fujita et al. | |
| 2010/0290822 | A1 | 11/2010 | Hasegawa et al. | |
| 2011/0026987 | A1 | 2/2011 | Hasegawa | |
| 2011/0026988 | A1 | 2/2011 | Yoshikawa et al. | |
| 2011/0044734 | A1 | 2/2011 | Shimokawa et al. | |
| 2011/0051201 | A1 | 3/2011 | Hashimoto et al. | |
| 2011/0052237 | A1 | 3/2011 | Yoshikawa et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0164904 | A1 | 7/2011 | Hirose et al. | |
| 2011/0176822 | A1 | 7/2011 | Ishii et al. | |
| 2011/0182609 | A1 * | 7/2011 | Hasegawa et al. | 399/94 |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0200370 | A1 | 8/2011 | Ikebuchi et al. | |
| 2011/0206425 | A1 | 8/2011 | Seto et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217091 | A1 | 9/2011 | Hirose et al. | |
| 2011/0217094 | A1 | 9/2011 | Hasegawa | |
| 2011/0217095 | A1 | 9/2011 | Ishii et al. | |
| 2011/0222875 | A1 | 9/2011 | Imada et al. | |
| 2011/0222929 | A1 | 9/2011 | Fujimoto et al. | |
| 2011/0222931 | A1 | 9/2011 | Shinshi et al. | |
| 2011/0222934 | A1 | 9/2011 | Hasegawa | |
| 2011/0229200 | A1 | 9/2011 | Yamaguchi et al. | |
| 2011/0305491 | A1 * | 12/2011 | Hasegawa et al. | 399/323 |

FOREIGN PATENT DOCUMENTS

| | | | | |
|---|---|---|---|---|
| JP | 60256180 | A | * | 12/1985 |
| JP | 2876127 | B2 | | 8/1990 |
| JP | 11-334191 | A | | 12/1999 |
| JP | 2007-086132 | A | | 4/2007 |
| JP | 2007-187715 | A | | 7/2007 |
| JP | 2007233228 | A | * | 9/2007 |
| JP | 2007240920 | A | | 9/2007 |
| JP | 2007240921 | A | * | 9/2007 |
| JP | 2008102408 | A | | 5/2008 |
| JP | 2009-031759 | A | | 2/2009 |

OTHER PUBLICATIONS

Abstract for patent publication No. US-3955813 (which corresponds to JP-51-104350-A).

* cited by examiner (a)

(b)

(a)

(b)

IMAGE FORMING APPARATUS HAVING FIXING DEVICE WITH AIR NOZZLE FOR SEPARATING SHEET

CROSS-REFERENCE TO RELATED APPLICATIONS

The present patent application claims priority pursuant to 35 U.S.C. §119 from Japanese Patent Application Nos. 2010-161473, and 2010-207481, filed on Jul. 16, 2010 and Sep. 16, 2010, respectively, which is hereby incorporated by reference herein in its entirety.

BACKGROUND

1. Field of the Invention

The present invention relates to an image forming apparatus including a fixing device which separates sheets of recording media by injecting compressed air.

2. Description of the Background

In electrophotographic image forming apparatuses such as printers and copiers, a toner image is formed on a recording medium (e.g., a sheet of paper) and fixed thereon by application of heat and pressure from a fixing device. The fixing device generally includes a heating member (e.g., a heating roller) and a pressing member (e.g., a pressing roller). The pressing member is pressed against the heating member to form a fixing nip through which the sheet having the toner image passes to receive heat and pressure. As the heating member, seamless belts are widely used. Such seamless-belt-like fixing members (hereinafter "fixing belts") contribute to energy saving because their heat capacity are so small that the warm-up time can be reduced.

The toner image fused on a sheet contacts the fixing roller or belt. Thus, the fixing roller or belt is generally coated with a fluororesin having high releasability. Additionally, a separation claw is generally provided for separating the sheet from the fixing roller or belt. Disadvantageously, the separation claw is likely to make scratches on the fixing roller or belt, which appear as undesired lines in the resulting image.

Typical monochrome image forming apparatuses employ a metallic roller whose surface is covered with TEFLON (trademark) as the fixing roller. Such a roller is resistant to scratch making by the separation claw and can be used for an extended period of time.

On the other hand, typical full-color image forming apparatuses employ a member whose surface is covered with a silicone rubber coated with a fluorine-based material (e.g., a PFA tube having a thickness of several tens micron) or a silicone oil, for the purpose of improving chromogenic properties of the resulting image. Such a configuration makes the surface of the fixing member too soft to be resistant to scratch making. Scratches made on the surface result in undesired lines in the fixed image. Thus, recent full-color image forming apparatuses do not employ a member that contacts the fixing member, such as the separation claw, and separate sheets from the fixing member without any member.

In such sheet separation without any member, when toner is adhesive to the fixing member, a sheet having the fixed toner image is likely to wind around the fixing member, causing paper winding jam. In particular, a full-color toner image, comprised of multiple toner layers, is more likely to cause paper winding jam because of its higher adhesiveness to the fixing member.

The following sheet separation systems are widely employed recently.

1) A non-contact separation plate system in which a separation plate is provided parallel to the longitudinal and width direction of a fixing roller or belt, forming a micro gap (about 0.2 to 1.0 mm) between the fixing roller or belt.
2) A non-contact separation claw system in which multiple separation claws are provided at a predetermined interval, forming a micro gap (about 0.2 to 1.0 mm) between a fixing roller or belt.
3) A self-stripping system in which sheets self-separate from a fixing roller or belt due to flexibility of the sheets and elasticity of flexure of the fixing roller or belt.

Additionally, Japanese Patent Application Publication No. (hereinafter "JP-A") 2009-31759 also describes a separation plate system.

In the above systems, a gap between an exit of the fixing nip and a sheet guide plate is relatively large. Therefore, thin sheets, sheets having little margin on their leading edge, or sheets having solid images (e.g., photograph) are likely to pass through the gap without separating from the fixing member, causing paper winding jam. Or such sheets are likely to bump the separation plate or claw, causing paper jam.

In view of such situations, there have been proposals to separate sheets from a fixing member by air injection. For example, JP-S51-104350-A, Japanese Patent No. 2876127, JP-H11-334191-A, JP-2007-187715-A, JP-2007-240920-A, JP-2008-102408-A, and JP-2007-86132-A propose to inject air into between a fixing member and a sheet having the fixed toner image so that the sheet forcibly separates from the fixing member.

For the purpose of saving energy and downsizing compressor (i.e., compressed air generator), generally, compressed air is injected for only a part of the time period during which a leading edge of a sheet passes the fixing nip, so that only the leading edge separates from the fixing member and is introduced into a separation plate or sheet guide.

On the other hand, full-color toner images generally include toner in a large amount and are high at gloss. A sheet having such a full-color toner image separates from the fixing member at immediately downstream from the exit of the fixing nip by the action of the injected compressed air, but starts to wind around the fixing member after stopping injecting compressed air while being introduced into a separation plate or sheet guide.

As a result, every portion on the fixing member receives different amounts of heat depending on whether or not compressed air is injected. Thus, the resulting image has uneven surface smoothness, i.e., uneven gloss and image density.

FIG. 1A schematically illustrates a behavior of a sheet P when compressed air is injected. In FIG. 1A, the sheet P is separated from a fixing belt at immediately downstream from the exit of the fixing nip. FIG. 1B schematically illustrates a behavior of a sheet P when compressed air is not injected. In FIG. 1B, the sheet P is separated from a fixing belt while slightly winding to the fixing member. FIG. 2 schematically illustrates a solid image showing that the gloss level is different between areas corresponding to portions on the fixing member where compressed air is injected or not. Such gloss difference is generated due to the difference in received heat quantity between the portions on the fixing member where compressed air is injected or not.

The problem of uneven gloss and image density can be solved by injecting compressed air over an entire period of time during which an entire sheet, from a leading edge to a rear edge, passes through the fixing nip.

To separate a leading edge of a sheet from the fixing member, compressed air is required to be injected at a high pressure. This is because the leading edge tends to wind around the fixing member. In particular, the separation force is required to exceed the total of the adhesive force between the fixing member and toner, and flexibility of the sheet. The injection pressure required at this time is hereinafter referred to as the pressure Ps.

After the leading edge is separated from the fixing member and introduced into a sheet guide, the flexibility of the sheet now acts as separation force. Thus, the injection pressure needs not to be high at this time. The injection pressure required at this time is hereinafter referred to as the pressure Pk.

In summary, when separating a leading edge of a sheet from a fixing member, at least the pressure Ps is required. After separating the leading edge of the sheet from the fixing member and introducing it into a sheet guide, at least the pressure Pk is required.

In continuous sheet feeding, compressed air is also continuously injected while reducing the tank pressure of a compressor. To keep injecting compressed air at the required injection pressure Ps even when the tank pressure is reduced, flow rate (per unit time) is required to be as large as possible. As a result, the compressor gets larger undesirably.

SUMMARY

Exemplary aspects of the present invention are put forward in view of the above-described circumstances, and provide a novel image forming apparatus that reliably separates sheets of recording media by air injection using a compact compressor and produces high-quality images without uneven gloss or uneven image density.

In one exemplary embodiment, an image forming apparatus comprises a fixing device to fix a toner image on a recoding medium; a compressed air generator to generate a compressed air; an air nozzle to inject the compressed air to separate the recording medium having the fixed toner image from the fixing device; a first switching unit to switch the air nozzle between injection and termination, which is provided upstream from the air nozzle; and a buffer unit to retain the compressed air, which is provided upstream from the air nozzle and downstream from the first switching unit. In this image forming apparatus, the first switching unit terminates compressed air injection after a leading edge of the recording medium is separated from the fixing device. Thus, the compressed air flow rate is gradually reduced, and no difference in gloss level appears between injected and non-injected portions in the resulting image. The image forming apparatus provides the above feature only by including the buffer unit having a simple configuration without increasing the volume of the compressed air generator or the number of switching units, preventing cost rise and growing in size.

In another exemplary embodiment, the air nozzle has an injection outlet having an area of 1 $mm^2$ or less. According to this embodiment, the compressed air flow rate is reduced in a favorable manner due to flow path resistance of the air nozzle after compressed air injection is terminated. Additionally, compressed air is injected from the air nozzle at a proper flow rate to separate sheets.

In another exemplary embodiment, the buffer unit is comprised of a piping that connects the air nozzle and the first switching unit. According to this embodiment, the buffer unit can be formed by extending a simple piping connecting the air nozzle and the first switching unit, resulting in cost reduction. In the above-described image forming apparatus, the required buffer volume is 300 cc at most. Therefore, the buffer unit can be formed by, for example, extending a practical tube having an inner diameter of 5 to 10 mm.

In another exemplary embodiment, the buffer unit is comprised of an extendable piping that connects the air nozzle and the first switching unit, and the fixing device and the air nozzle are included in a fixing unit. The fixing unit is drawable out of the image forming apparatus while connecting to the buffer unit. According to this embodiment, the required buffer volume can be reliably obtained with a simple buffer unit. The fixing unit can be drawn out of the image forming apparatus without disconnecting from the pneumatic piping to the air nozzle, improving handleability in jamming or maintenance. Because air injection can be performed while drawing the fixing unit out of the image forming apparatus, users can easily and reliably check whether the nozzle normally operates or not.

In another exemplary embodiment, the extendable piping is a spiral tube. According to this embodiment, the buffer unit can be formed at low cost.

In another exemplary embodiment, the image forming apparatus further comprises a second switching unit provided upstream from the air nozzle and downstream from the buffer unit. The air nozzle injects the compressed air when the second switching unit is opened, and terminates when the first switching unit is closed. According to this embodiment, the injection pressure rapidly rises up at the beginning of air injection. Thus, the injection pressure rapidly reaches a high pressure required for separating a leading edge of the recording medium. When air injection is terminated, the compressed air flow rate from the air nozzle is gradually reduced. Thus, no gloss difference appears in the resulting image. Additionally, because the volume of the buffer unit provided between the first switching unit and the second switching unit can be made larger, the compressed air flow rate is more gradually reduced. Thus, compressed air is kept injected while an entire recording medium passes through the nozzles, even when the recording medium is long.

In another exemplary embodiment, the second switching unit is closed after a rear edge of the recording medium passes through the air nozzle. According to this embodiment, idle air injection can be stopped while the flow rate is gradually reduced. Thus, compressed air can be effectively supplied in continuous printing.

In another exemplary embodiment, the image forming apparatus further comprises a second switching unit provided in parallel to the first switching unit, and the buffer unit is provided upstream from the air nozzle and downstream from the second switching unit. According to this embodiment, because two switching units are provided in parallel and independently controllable, the injection pressure can be switched between a high pressure required for separating a leading edge of the recording medium and a low pressure required for stabilizing behavior of the recording medium. The second switching unit keeps air injection until a rear edge of the recording medium passes through the nozzle, even when the recording medium is long.

In another exemplary embodiment, the image forming apparatus further comprises a small-diameter path provided downstream from the buffer unit and upstream from a junction with a flow path that connects the first switching unit and the air nozzle. The small-diameter path has a narrower cross-sectional area than that of said flow path. According to this embodiment, the injection pressure can be switched between a high pressure required for separating a leading edge of the recording medium and a low pressure by changing flow path resistance.

In another exemplary embodiment, the small-diameter path is comprised of a flow rate control valve. According to this embodiment, an optimum injection pressure can be obtained by controlling the flow rate control valve regardless of apparatus conditions.

In another exemplary embodiment, the flow rate control valve is an electric proportional control valve. According to this embodiment, an optimum injection pressure can be automatically (electrically) obtained according to thickness of the recording medium or environmental conditions. The injection pressure can be controlled in the process of image forming.

In another exemplary embodiment, the first switching unit is opened while a leading edge of the recording medium passes through the air nozzle, and the second switching unit is opened while the leading edge and a rear edge of the recording medium passes through the air nozzle. According to this embodiment, the injection pressure is effectively controlled so as to have a high pressure only when separating a leading edge of the recording medium and to have a minimum pressure at the rest of the operation.

In another exemplary embodiment, the second switching unit is opened earlier than the first switching unit is opened. According to this embodiment, the buffer unit is previously filled with compressed air by opening the second switching unit. Thus, the injection pressure rapidly rises up when the first switching unit is opened and rapidly reaches a high pressure required for separating a leading edge of the recording medium.

In another exemplary embodiment, at least one of the switching unit and the second switching unit is an electromagnetic valve. According to this embodiment, air injection and termination can be easily switched by a low-cost and simple electromagnetic valve.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
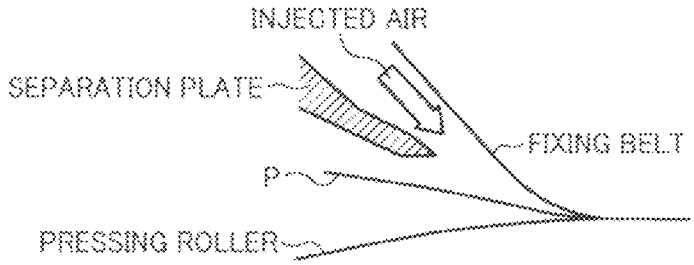
FIG. 1A RELATED ART
FIG. 1A schematically illustrates a behavior of a sheet P when compressed air is injected.
Figure 1B:
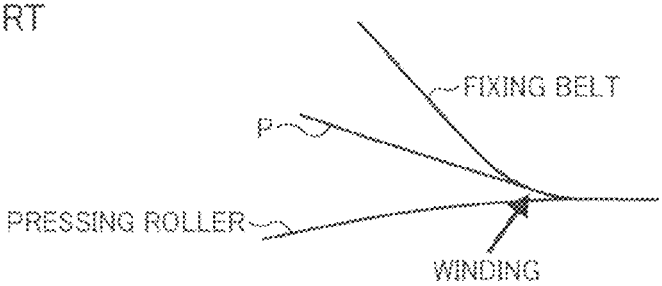
FIG. 1B RELATED ART
FIG. 1B schematically illustrates a behavior of a sheet P when compressed air is not injected.
Figure 2:
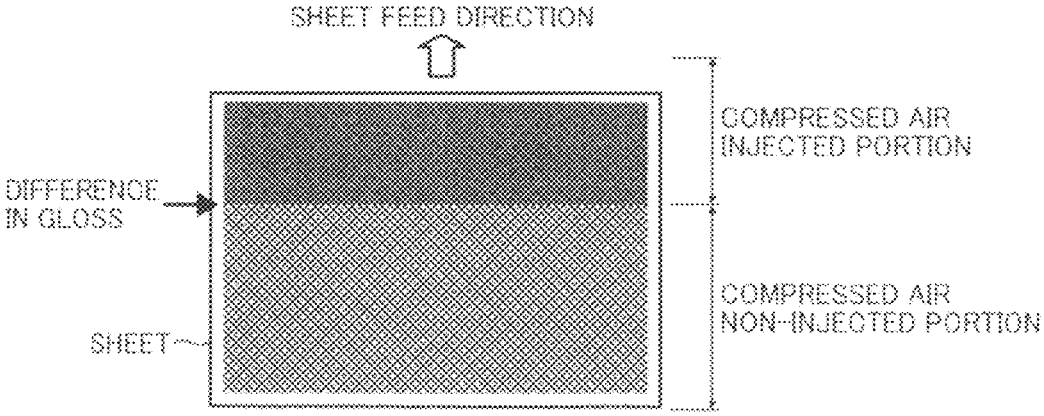
FIG. 2 RELATED ART
FIG. 2 schematically illustrates a solid image showing that the gloss level is different between areas corresponding to portions on the fixing member where compressed air is injected or not.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Typically, but not necessarily, paper is the medium from which is made a sheet on which an image is to be formed. Other printable media is available in sheets and their use here is included. For simplicity, this Detailed Description section refers to paper, sheets thereof, paper feeder, etc. It should be understood, however, that the sheets, etc., are not limited only to paper.

First, experimental results that have led the exemplary embodiments are described in detail.

Figure 3:
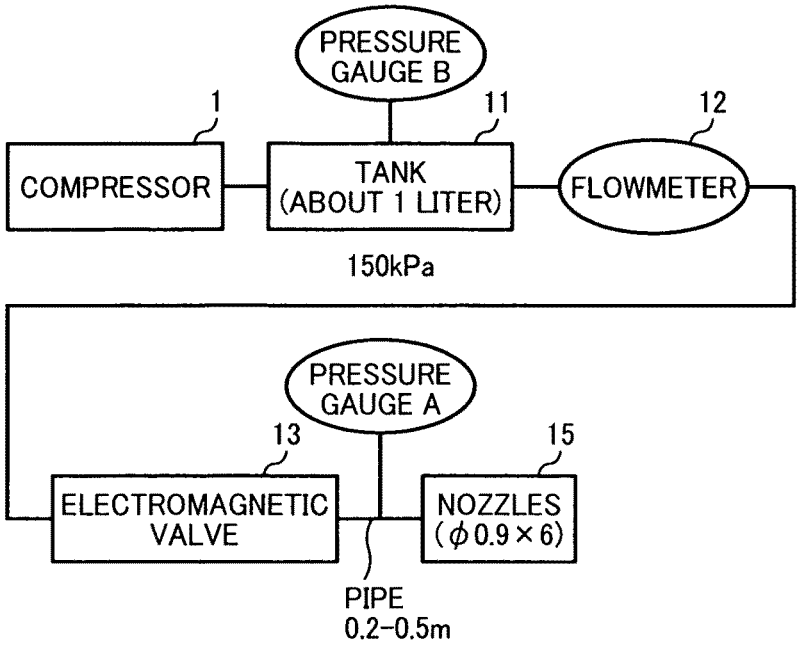
FIG. 3 is a configuration diagram of an air injection separation system in which compressed air is injected from air nozzles to separate leading edges of sheets.

FIG. 3 is a configuration diagram of an air injection separation system in which compressed air is injected from air nozzles to separate leading edges of sheets. As illustrated in FIG. 3, an electromagnetic valve 13 is provided adjacent to air nozzles 15 (at a distance of about 0.2 to 0.5 m). Air injection is switched on and off by opening and closing the electromagnetic valve 13. A tank 11 is provided upstream from the electromagnetic valve 13. The tank 11 stores compressed air that is continuously supplied from a compressor 1 while keeping a high pressure (for example, about 0.2 MPa) to stabilize the compressed air. The compressed air is intermittently supplied to the nozzles 15 by opening and closing the electromagnetic valve 13. A pressure gauge A is provided upstream from the air nozzles 15 to measure the pre-nozzle pressure. A pressure gauge B is provided to the tank 11 to measure the inner pressure of the tank 11.

Figure 4:
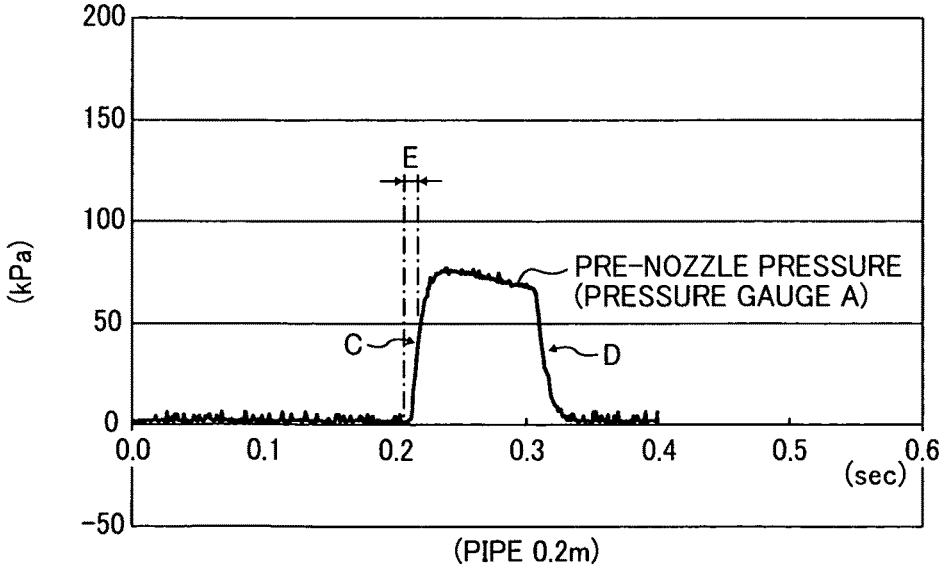
FIG. 4 is a graph showing injection pressure fluctuation of the system illustrated in FIG. 3.

FIG. 4 is a graph showing injection pressure (i.e., the pre-nozzle pressure measured by the pressure gauge A) fluctuation of the system illustrated in FIG. 3 in which six nozzles each having a diameter of 0.9 mm are provided. As illustrated in FIG. 4, about 0.2 seconds after a sensor provided at the enter of the fixing nip detects a leading edge of a sheet (in other words, immediately before the leading edge of the sheet gets out of the fixing nip), the electromagnetic valve 13 is opened for only 0.1 seconds so that the compressed air is introduced into each of the air nozzles 15 from the tank 11.

Each of the air nozzles 15 and the electromagnetic valve 13 are connected with a pipe having an inner diameter of 5 mm and a length of about 20 cm. The pipe having such a length makes the injection pressure rapidly rise up (shown by C in FIG. 4) by opening the electromagnetic valve 13 and rapidly fall down (shown by D in FIG. 4) by closing the electromagnetic valve 13. Because the pre-nozzle pressure and the compressed air flow rate from the nozzles are proportional, air injection can be effectively performed by monitoring the pre-nozzle pressure.

On the other hand, in the above-described injection pressure fluctuation profile, the boundary between the injected period and the non-injected period is so clear that a difference in gloss level clearly appears in the resulting image, significantly degrading its image quality.

Figure 5:
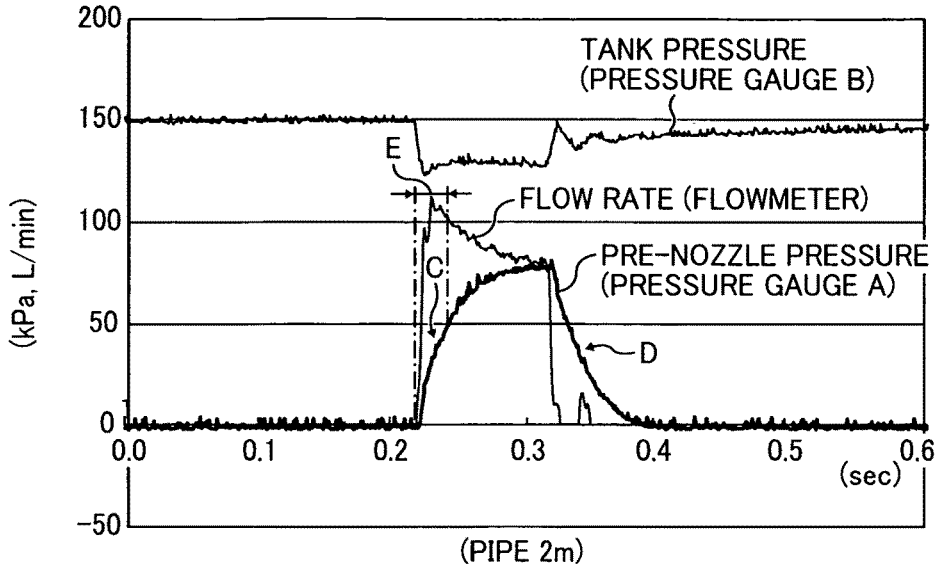
FIG. 5 is a graph showing injection pressure fluctuation of a system similar to that illustrated in FIG. 3 in which the pipe length between the air nozzles and the electromagnetic valve is extended.

FIG. 5 is a graph showing injection pressure fluctuation of a system similar to that illustrated in FIG. 3 in which six nozzles each having a diameter of 0.9 mm are provided, except that the pipe length between the air nozzles 15 and the electromagnetic valve 13 is changed from about 20 cm to about 2 m. Referring to FIG. 5, in a similar way to FIG. 4, about 0.2 seconds after a sensor provided at the enter of the fixing nip detects a leading edge of a sheet, the electromagnetic valve 13 is opened for only 0.1 seconds. But the injection pressure more gradually rises up (shown by C in FIG. 5) than in FIG. 4 before the nozzles 15 start injecting compressed air because the pipe having a volume of about 40 cc (i.e., inner diameter of 5 mm×length of 2 m) buffers the compressed air. Similarly, after the electromagnetic valve 13 is closed, the injection pressure more gradually falls down (shown by D in FIG. 5) because the compressed air accumulated in the pipe having a length of 2 m is gradually discharged therefrom. The same goes for the compressed air flow rate from the nozzles 15 that is proportional to the pre-nozzle pressure. Thus, the compressed air flow rate gradually falls down after air injection is terminated. The inventors of the present invention found that the problem of low-quality image having gloss difference can be prevented by providing a buffer unit upstream from the air nozzles 15 (i.e., between the air nozzles 15 and the electromagnetic valve 13) so that the compressed air flow rate gradually falls down after air injection is terminated.

Figure 6:
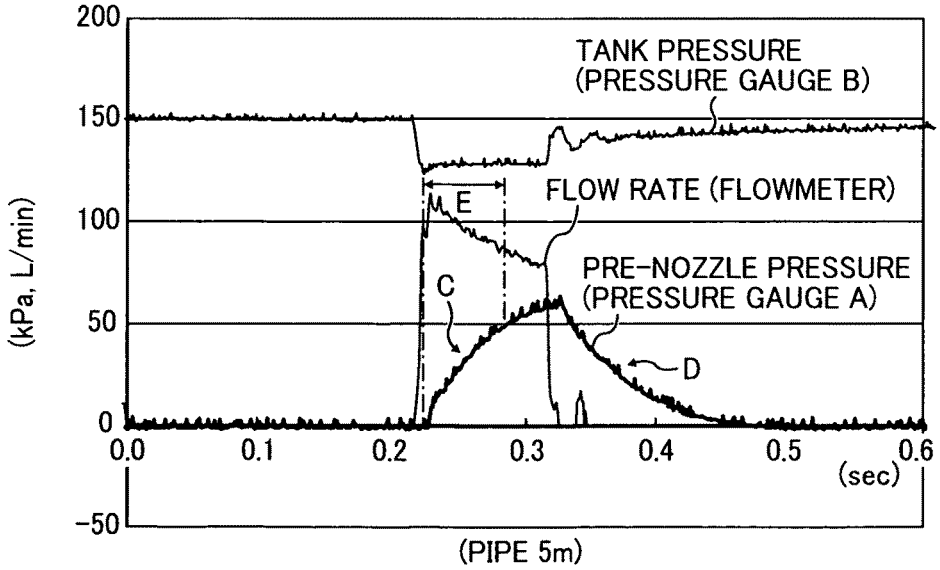
FIG. 6 is a graph showing injection pressure fluctuation of a system similar to that illustrated in FIG. 3 in which the distance between the air nozzles and the electromagnetic valve is further extended.

FIG. 6 is a graph showing injection pressure fluctuation of a system similar to that illustrated in FIG. 3 except that the distance between the air nozzles 15 and the electromagnetic valve 13 is changed to about 5 m. In this case, the pipe having a greater volume of about 100 cc buffers the compressed air. Thus, the injection pressure more gradually rises up (shown by C in FIG. 6) and more gradually falls down (shown by D in FIG. 6) than in FIG. 5. FIG. 5 and FIG. 6 further show tank pressure fluctuation (measured by the pressure gauge B) and compressed air flow rate (liter/min) fluctuation (measured by the flowmeter 12) at immediately downstream from the tank 11. Because the system configurations upstream from the electromagnetic valve 13 (i.e., between the compressor 1 and the electromagnetic valve 13) are the same, there is no difference in the tank pressure fluctuation and compressed air flow rate fluctuation between FIG. 5 and FIG. 6 (as well as FIG. 4).

In summary, it is possible to make the compressed air flow rate gradually fall down after air injection is terminated (i.e., the electromagnetic valve 13 is closed) by changing the distance between the air nozzles 15 and the electromagnetic valve 13. The degree of reduction of the compressed air flow rate depends on flow path resistance that further depends on diameter, shape, and number of the nozzles. Thus, the pipe volume (or length in FIG. 3) for buffering compressed air is optimized according to air nozzle conditions (e.g., diameter, number, shape).

By providing a buffer unit between the air nozzles 15 and the electromagnetic valve 13, the injection pressure and flow rate gradually fall down over a period of time during which both a leading edge and a rear edge of a sheet pass the sheet separation part. At the same time, rising up of the injection pressure also becomes more gradual. When the leading edge of the sheet reaches a vicinity of the nozzles, a high pressure (or flow rate) is required to separate the leading edge. In a case in which rising up of the injection pressure is gradual, air injection should be started at an earlier time because it takes a longer time for the injection pressure to reach a required pressure. For example, in a case in which the required pre-nozzle pressure for separating a leading edge is 50 kPa, the time period (E) during which the injection pressure reaches the required pressure becomes longer as rising up of the injection pressure becomes more gradual, as shown in FIG. 4 to FIG. 6. As the time period (E) becomes longer, variation in the time period (E) becomes larger. As a result, the required pressure is obtained unreliably. Accordingly, rising up of the injection pressure is preferably as rapid as possible, as shown in FIG. 4.

Figure 7:
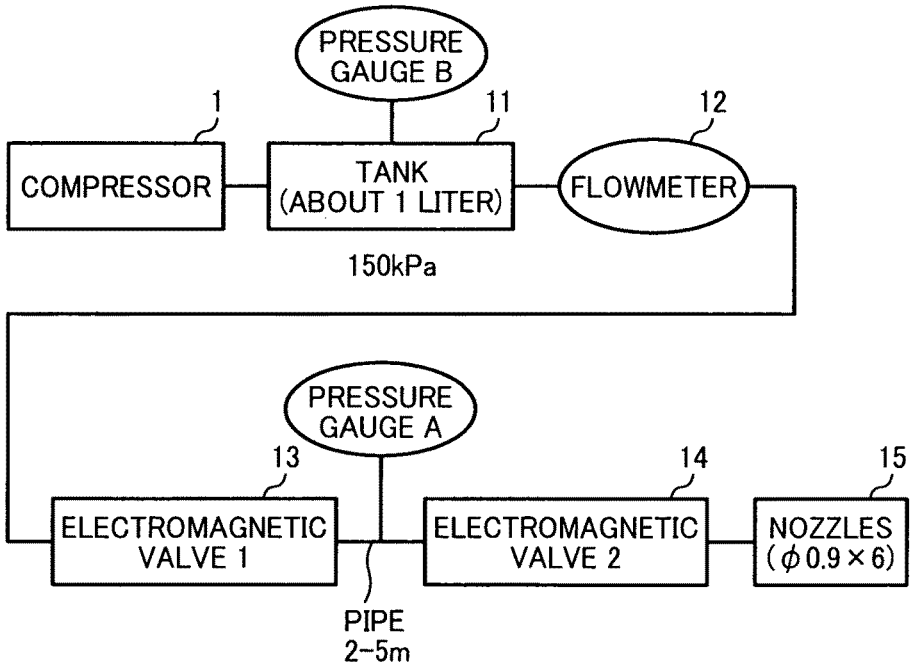
FIG. 7 is a configuration diagram of an air injection separation system similar to that illustrated in FIG. 3 in which a second electromagnetic valve is further provided.

FIG. 7 is a configuration diagram of an air injection separation system further including a second electromagnetic valve 14 tandemly provided between the nozzles 15 and the first electromagnetic valve 13, and a buffer unit having a volume of 40 cc or more provided between the first electromagnetic valve 13 and the second electromagnetic valve 14. In the system illustrated in FIG.7, the injection pressure rapidly rises up and gradually falls down after air injection is terminated. The distance (i.e., the pipe length) between the nozzles 15 and the second electromagnetic valve 14 is about 200 mm. The buffer unit having a volume of 40 cc or more is comprised of a pipe having a length of 2 to 5 m that connects the first electromagnetic valve 13 and the second electromagnetic valve 14.

Figure 8:
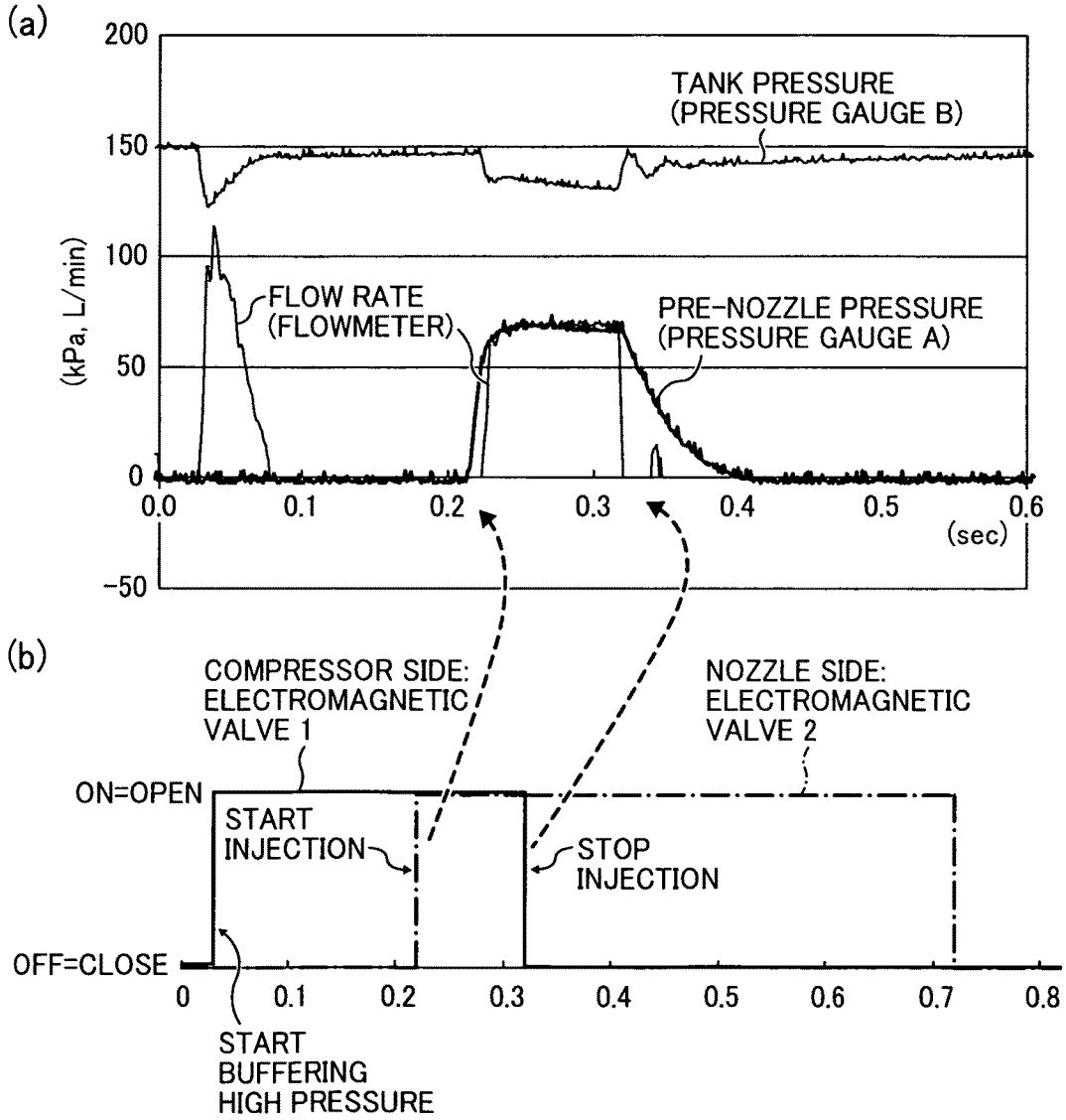
FIG. 8(*a*) and FIG. 8(*b*) are a graph showing injection pressure fluctuation and a timing chart for opening and closing the first electromagnetic valve and the second electromagnetic valve of the system illustrated in FIG. 7, respectively.

In air injection operation, first, the first electromagnetic valve 13 is switched on (i.e., opened) and the second electromagnetic valve 14 is switched off (i.e., closed) so that the pressure between the first electromagnetic valve 13 and the second electromagnetic valve 14 is increased to nearly the tank pressure (about 0.2 MPa) before a leading edge of a sheet reaches a vicinity of the nozzles. Immediately before the leading edge of the sheet reaches the vicinity of the nozzles (i.e., about 0.2 seconds after a sensor provided at the entrance of the fixing nip detects the leading edge), the second electromagnetic valve 14 is switched on (i.e., opened). FIG. 8(*a*) is a graph showing injection pressure fluctuation of the system illustrated in FIG. 7. FIG. 8(*b*) is a timing chart for opening and closing the first electromagnetic valve 13 and the second electromagnetic valve 14. As illustrated in FIG. 8(*a*), at the beginning of air injection, the injection pressure rapidly rises up in a similar way to FIG. 4. Accordingly, a high pressure (flow rate) for separating a leading edge of a sheet can be obtained.

After the leading edge is separated and is passed through the nozzles, the high pressure is not required. Thus, as illustrated in FIG. 8(*b*), compressed air injection is terminated by closing the first electromagnetic valve 13 while keeping the second electromagnetic valve 14 opened. After the first electromagnetic valve 13 is closed, compressed air is gradually supplied to the nozzles 15 from the buffer unit provided between the first electromagnetic valve 13 and the second electromagnetic valve 14. Thus, the injection pressure gradually falls down in a similar way to FIG. 5 and FIG. 6.

The system illustrated in FIG. 7 provides an exemplary air injection profile in which the injection pressure rapidly rises up and gradually falls down after air injection is terminated. FIG. 8(*a*) also shows tank pressure fluctuation (measured by the pressure gauge B) and compressed air flow rate (liter/min) fluctuation (measured by the flowmeter 12) at immediately downstream from the tank 11. The latter shows flow rates measured while the first electromagnetic valve 13 is opened and the buffer unit between the first electromagnetic valve 13 and the second electromagnetic valve 14 is filled with the compressed air. The tank pressure is reduced for a while accordingly. On the other hand, the pre-nozzle pressure (measured by the pressure gauge A) is not increased and kept atmosphere pressure level because the second electromagnetic valve 14 is kept closed.

Figure 9:
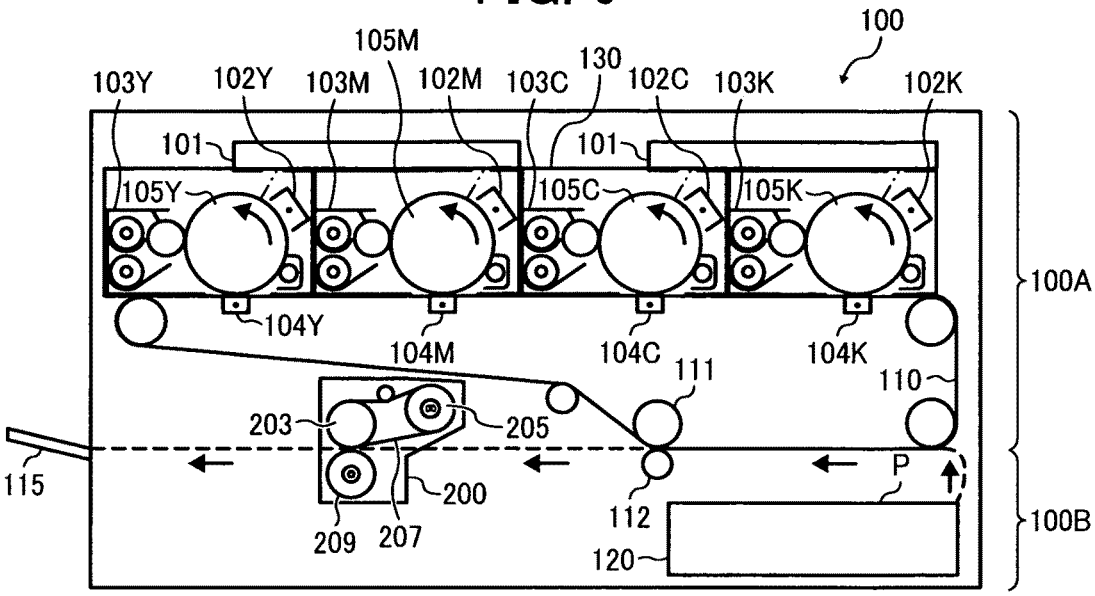
FIG. 9 schematically illustrates an image forming apparatus according to exemplary embodiments of the invention.

FIG. 9 schematically illustrates an image forming apparatus according to exemplary embodiments of the invention. An image forming apparatus 100 is a tandem-type high-speed full-color copier that includes an image forming part 100A provided at the center, a paper feed part 100B provided below the image forming part 100A, and an image reading part, not shown. The image forming part 100A includes a fixing device 200.

The image forming part 100A further includes an intermediate transfer belt 110 having a transfer surface stretched in a horizontal direction. Along the upper transfer surface of the intermediate transfer belt 110, photoconductors 105Y, 105M, 105C, and 105K are tandemly arranged. The photoconductors 105Y, 105M, 105C, and 105K bear respective toner images of yellow, magenta, cyan, and black, which are complementary colors of color separation colors.

The photoconductors 105Y, 105M, 105C, and 105K are rotatable in the same direction (i.e., counterclockwise in FIG. 9). Around the photoconductors 105Y, 105M, 105C, and 105K, optical writing devices 101; respective chargers 102Y, 102M, 102C, and 102K; respective developing devices 103Y, 103M, 103C, and 103K; respective primary transfer devices 104Y, 104M, 104C, and 104K; and respective cleaning devices are provided. The developing devices 103Y, 103M, 103C, and 103K contain respective toners of yellow, magenta, cyan, and black. Each of the photoconductors 105, the chargers 102, and the developing devices 103 form an image forming unit. (The additional characters Y, M, C, and K representing toner colors of yellow, magenta, cyan, and black, respectively, are omitted appropriately.)

The intermediate transfer belt 110 is stretched with a driving roller and driven rollers and is movable in the same direction as the photoconductors 105Y, 105M, 105C, and 105K while facing the photoconductors 105Y, 105M, 105C, and 105K. A secondary transfer roller 112 is provided facing a roller 111 which is one of the driven rollers. A paper feed path for feeding a sheet of paper P (hereinafter "sheet P") from the secondary transfer roller 112 to the fixing device 200 is laterally provided.

The paper feed part 100B includes a paper feed tray 120 that stores sheets P and a feed mechanism that separates the top sheet in the paper feed tray 120 and feeds it toward the secondary transfer roller 112.

In image forming operation, first, a surface of the photoconductor 105Y is uniformly charged by the charger 102Y to form an electrostatic latent image based on image information transmitted from the image reading part. The electrostatic latent image is developed into a yellow toner image with a yellow toner contained in the developing device 103Y. The yellow toner image is then primarily transferred onto the intermediate transfer belt 110 by the primary transfer device 104Y to which a predetermined bias is applied. Similarly, magenta, cyan, and black toner images are formed on the respective photoconductors 105M, 105C, and 105K, and are transferred onto and superimposed on the intermediate transfer belt 110 by electrostatic force to form a composite toner image.

The composite toner image on the intermediate transfer belt 110 is further transferred onto the sheet P which is conveyed to between the roller 111 and the secondary transfer roller 112. The sheet P having the composite toner image thereon is then fed to the fixing device 200. The sheet P passes through a fixing nip formed between a fixing belt 207 and a pressing roller 209 so that the composite toner image is fixed on the sheet P. At the exit of the fixing nip, an air nozzle 215 (see FIG. 10 to be described in detail later) is provided on the side of the fixing belt 207. The air nozzle 215 injects air to make the sheet P discharge from the fixing nip without winding around the fixing belt 207 or pressing roller 209.

The sheet P discharged from the fixing nip is then fed to a stacker 115.

The image forming apparatus 100 including the fixing device 200 equipped with the air nozzle 215 performs excellent sheet separation and can be used for various types of papers or images.

Figure 10:
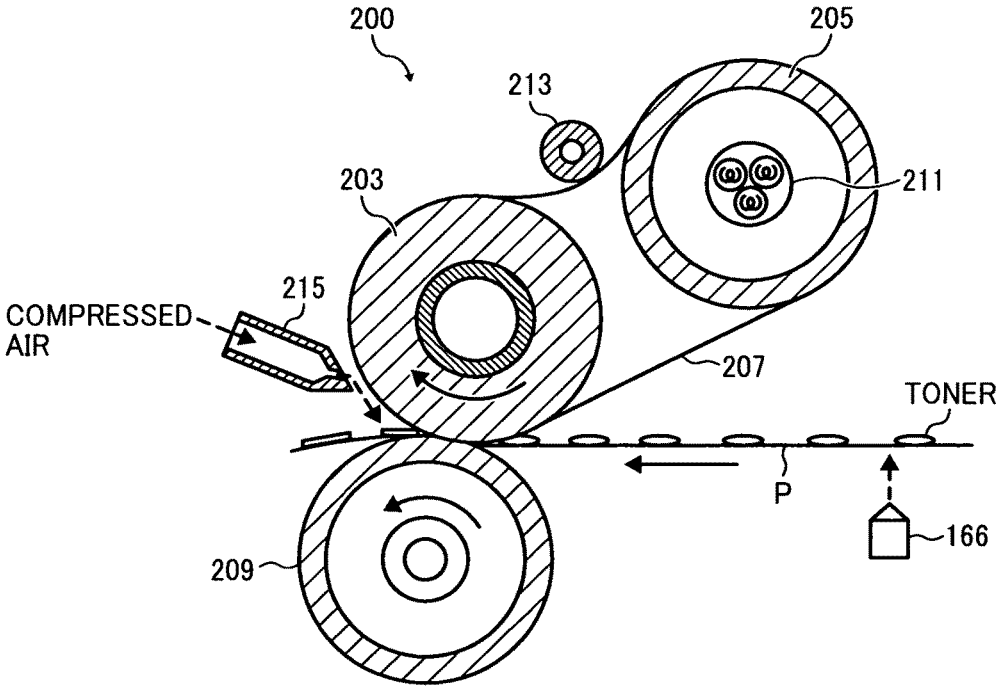
FIG. 10 is a cross-sectional view of the fixing device included in the image forming apparatus illustrated in FIG. 9.

FIG. 10 is a cross-sectional view of the fixing device 200. In the fixing device 200, the fixing belt 207 is stretched with a fixing roller 203 and a heating roller 205, and rotates clockwise in FIG. 10. The fixing roller 203 is a driving roller connected to a power source. The heating roller 205 is a driven roller.

The pressing roller 209 is provided facing the fixing roller 203 with the fixing belt 207 therebetween. A pressing mechanism, not shown, presses the pressing roller 209 against the fixing roller 203 with the fixing belt 207 therebetween. The heating roller 205 internally contains a fixing heater 211. The heating roller 205 is heated by the fixing heater 211, and the fixing belt 207 is heated by the heating roller 205. The fixing belt 207 is rotated by rotation of the fixing roller 203 being a driving roller, and the pressing roller 209 is rotated by rotation of the fixing belt 207.

Alternatively, the pressing roller 209 may be driven by another power source. In place of the above fixing device 200 employing fixing belt and pressing roller, another type of fixing device which employs a pair of fixing and pressing rollers may be also used.

The surface temperature of the fixing belt 207 is detected by a temperature sensor, not shown. A temperature controller, not shown, controls the fixing heater 211 based on outputs of the temperature sensor so that the fixing belt 207 has a desired surface temperature. At a vicinity of the entrance of the fixing device, an entrance sensor 166 that detects a sheet is provided.

The sheet P having an unfixed toner image thereon is conveyed to the fixing device 200 from the secondary transfer roller 112. The sheet P then passes through the fixing nip formed between the fixing belt 207 and the pressing roller 209 so that the toner image is melted and fixed on the sheet P by application of heat from the fixing belt 207 and the pressing roller 209. The sheet P having the fixed toner image is then discharged to the stacker 115.

To keep the tension of the fixing belt 207, a tension roller 213 is preferably provided. The tension roller 213 may be provided on either an external side of the fixing belt 207 as illustrate in FIG. 10 or an internal side of the fixing belt 207. The pressing roller 209 may be replaced with a pressing belt.

Figure 11:
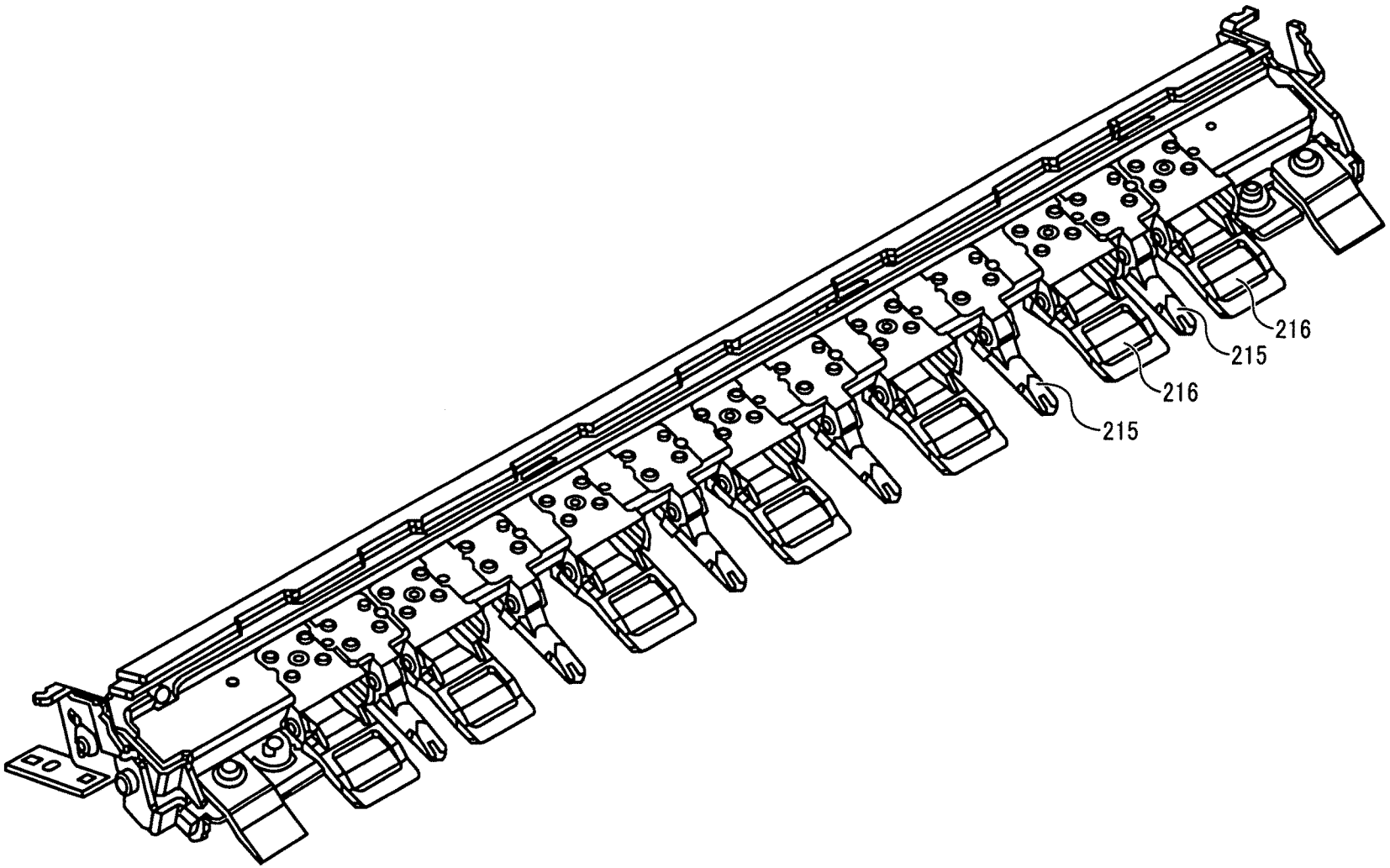
FIG. 11 schematically illustrates a separation plate having multiple non-contact separation claws and air nozzles tandemly arranged in the longitudinal direction of the pressing roller.

The air nozzle 215 is provided at a vicinity of the exit of the fixing nip while forming a micro gap between the fixing belt 207. In FIG. 10, only the tip of the air nozzle 215 is illustrated for the sake of simplicity. Alternatively, a separation plate having multiple non-contact separation claws 216 and air nozzles 215 tandemly arranged in the longitudinal direction of the pressing roller 219, as illustrated in FIG. 11, may be provided. Compressed air generated by a compressed air generator and controlled by the electromagnetic valves is injected form the air nozzle 215 once when a leading edge of the sheet P passes through the fixing nip. The compressed air forcibly separates the leading edge of the sheet P from the fixing belt 207, and the rest of the sheet P spontaneously separates by itself. When multiple sheets P continuously pass the fixing nip, compressed air is also continuously injected.

Figure 12:
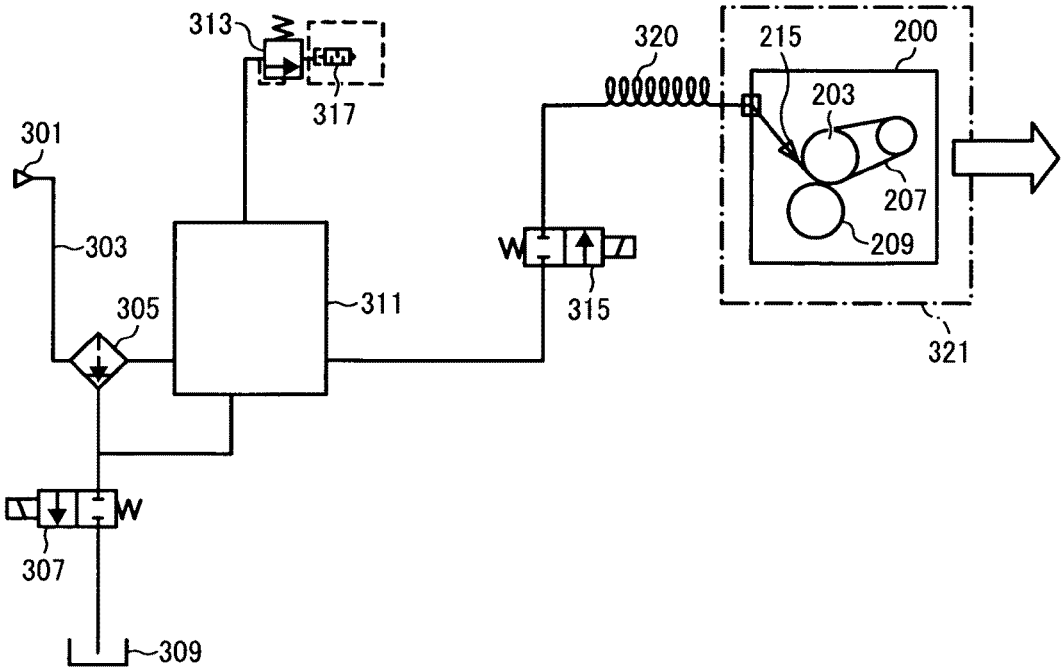
FIG. 12 schematically illustrates a first embodiment of a compressed air injector according to this specification.

FIG. 12 schematically illustrates a first embodiment of a compressed air injector according to this specification. The compressed air injector includes a compressor 301 serving as a compressed air generator and a pneumatic piping that supplies the compressed air from the compressor to the air nozzle 215.

The pneumatic piping is connected to the compressor 301. The compressor 301 may be, for example, a compact reciprocating compressor (output 100 W) equipped with a reciprocating engine, which can compress air to a pressure of about 0.5 MPa. Since the compressor 301 does not include a pressure controlling mechanism, a pressure controller is provided downstream from the compressor 301.

As the pressure in the pneumatic piping downstream from the compressor 301 increases, the flow rate (L/min) of the compressor 301 decreases. The compressor 301 does not get started unless the pressure in the pneumatic piping downstream from the compressor 301 is at least atmosphere pressure (about 0.1 MPa). A filter is provided to an air inlet of the compressor 301 to prevent foreign substances from getting into compressed air. Compressed air generated in the compressor 301 has a high temperature. The high-temperature compressed air is introduced into an air filter 305 through a tube 303 while being cooled with the tube 303 having a lower temperature. Water vapor in the compressed air is condensed by such cooling, producing drainage water.

The tube 303 may be, for example, a flexible hollow tube made of polyurethane, nylon, or fluororesin, or a metallic pipe. To cool the high-temperature compressed air to room temperature, the tube 303 preferably has a long enough length or is comprised of a metallic pipe having good thermal conductivity. To prevent drainage water from flowing back to the compressor 301, preferably, the tube 303 is provided downward from the compressor 301 or a check valve that closes due to back pressure of the drainage water is provided.

The air filter 305 is provided downstream from the tube 303. The air filter 305 removes foreign substances from compressed air, and accumulates and discharges drainage water from the piping. An auxiliary water separator that accumulates drainage water may be provided. Such a water separator does not have a function of removing foreign substances but can remove 99% of water.

The air filter 305 has a drainage port that is connected to an electromagnetic valve (solenoid valve) 307 being a 2-port valve. The electromagnetic valve 307 is opened and closed by electromagnetic force of electromagnet. The electromagnetic valve 307 has a function of discharging back pressure and drainage water from the piping by switching air pressure and hydraulic pressure. The electromagnetic valve 307 is controlled to open when the operation is stopped so that back pressure is removed from the piping and drainage water is discharged from the air filter 305. The drainage water discharged from the electromagnetic valve 307 drops in an evaporating dish 309 and is naturally evaporated.

An air tank 311 is provided downstream from the air filter 305. The air tank 311 buffers compressed air injected from the compressor 301 so that reliable compressed air injection is performed. The air tank 311 may be formed by welding steel plate having a thickness of 5 mm, for example. The air tank 311 has a volume of 1 liter, for example. When the volume of the air tank 311 is too large, it takes a long time to reach a predetermined pressure. Therefore, the air tank 311 preferably has the minimum volume which can stabilize air injection pressure from the air nozzle 215. It depends on specification of the air nozzle 215 whether the air tank 311 is necessarily provided or not. When the air filter 305 has a large volume, the air tank 311 is not necessarily provided.

The air tank 311 is preferably made of a rigid metal to be resistant to high pressure. In particular, the air tank 311 is resistant to more than the maximum possible pressure in the compressor 301. Such a metallic air tank 311 preferably contacts compressed air at an area as large as possible so that the compressed air is easily cooled. Water vapor which is not condensed into drainage water at upstream sides of the air tank 311 is condensed into drainage water in the air tank 311. The drainage water adheres to inner walls of the air tank 311 and accumulated therein. A drainage port is provided to the bottom of the air tank 311 and is connected to the electromagnetic valve 307. Back pressure and drainage water are discharged from the air tank 311 by the action of the electromagnetic valve 307 when the operation is stopped.

The air tank 311 is connected to a pressure control valve (relief valve) 313. The pressure control valve 313 is controlled by a screw so that the air tank 311 has a predetermined pressure when the compressor 301 is in operation. In the present embodiment, the air tank 311 is controlled to have a pressure of about 0.2 MPa when the compressor 301 is in operation.

The pressure control valve (relief valve) 313 is opened when the inner pressure of the tank exceeds a specified pressure (relief pressure), and is closed when the inner pressure of the tank falls below the specified pressure (relief pressure). Thus, the tank pressure can be kept constant. In the present embodiment, the specified pressure is about 0.2 MPa.

The pressure control valve (relief valve) 313 mechanically discharges excessive pressure (air) by the action of a balanced combination of air pressure and spring. Therefore, the present embodiment can provide the following advantages.

(1) There is no need to control switching on/off of the compressor 301 regardless of the inner pressure of the air tank 311.

(2) The pressure control valve 313 can reliably keep the inner pressure of the air tank 311 constant.

(3) The air tank 311 never has a high pressure even when the compressor 301 is in continuous operation, being in no danger of explosion or destruction.

The relief valve is simple and resistant to pressure fluctuation in air injection. Thus, the relief valve is one of the optimum members for air pressure circuit in apparatuses with low air flow rate.

The air tank 311 is connected to an electromagnetic valve 315 being a 2-port electromagnetic valve provided downstream from the air tank 311. When the power is switched on, the electromagnetic valve 315 is opened so that compressed air in the air tank 311 is injected from the air nozzle 215. The electromagnetic valve 315 is closed when the power is switched off.

Referring back to FIG. 10, when the entrance sensor 166 detects the sheet P, a controller, not shown, sends out a signal for starting air injection at a predetermined timing. The electromagnetic valve 315 drives for 100 ms before the leading edge of the sheet P reaches the air nozzle 215. The air nozzle 215 injects air for 100 ms per sheet so that the leading edge of the sheet P separates from the fixing belt 207 and the pressing roller 209. Thereafter, the electromagnetic valve 315 stops driving (i.e., is closed) to terminate air injection. The air nozzle 215 effectively prevents the sheet P from jamming even when the leading edge bumps the separation plate or claw.

The electromagnetic valve 315 and the air nozzle 215 are connected by an extendable spiral tube 320. The spiral tube 320 serves as the buffer unit provided upstream from the air nozzle 215. A fixing unit 321 is slidably engaged with a guide rail so as to be drawable rightward in FIG. 12. The fixing unit 312 can be drawn out of the image forming apparatus due to extendability of the spiral tube 320. Thus, maintenance and repair of the fixing unit 312 can be easily made. The spiral tube 320 is simpler and cheaper than a conventional joint member that requires position adjustment and stiffness. Because the compressed air supplying circuit can be driven even when the fixing unit 321 is drawn out, users can easily and reliably check whether the nozzle normally operates or not.

The spiral tube 320 may be, for example, a flexible hollow tube made of polyurethane, nylon, or fluororesin. The spiral tube 320 has a proper length so as to have a proper buffer volume as explained referring to FIG.5 and FIG. 6. In the present embodiment, six air nozzles 215 and separation claws 216 are alternately and tandemly arranged in the longitudinal direction of the pressing roller 209, as illustrated in FIG. 11. Each of the air nozzles 215 has a diameter of 0.9 mm. Therefore, the spiral tube 320 preferably has a length of 2 m or more and the inner diameter is 5 mm. With such a configuration, the pressure (flow rate) gradually falls down, as shown in FIG. 5 and FIG. 6, after the electromagnetic valve 315 stops driving (i.e., is closed). Accordingly, no difference in gloss level appears between injected and non-injected portions in the resulting image.

Figure 13:
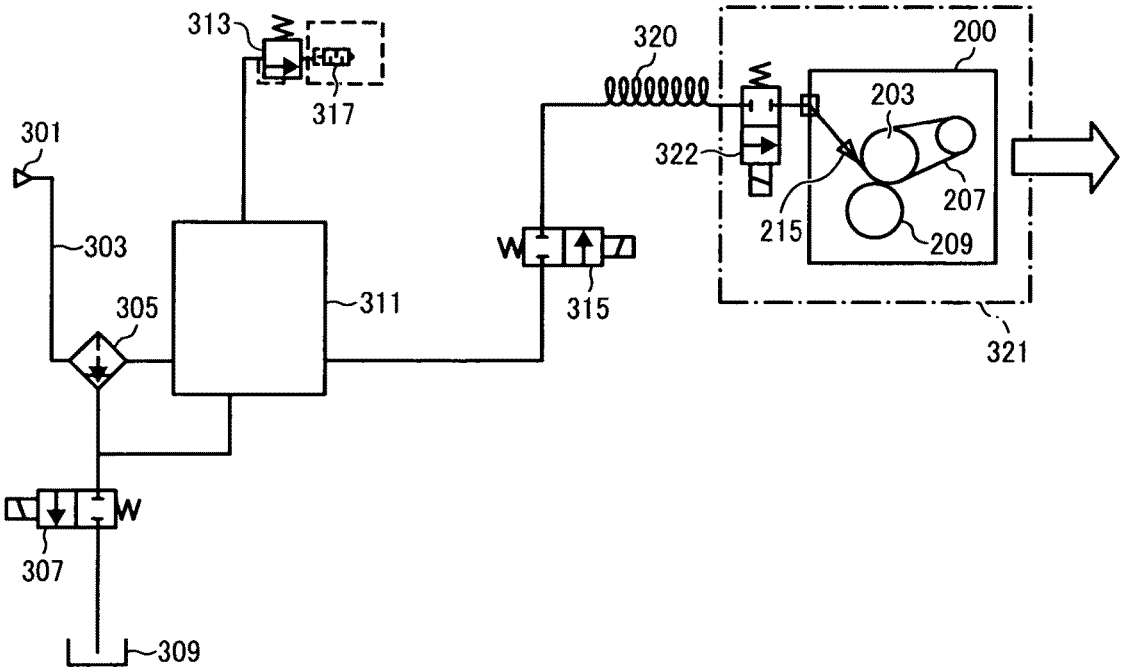
FIG. 13 schematically illustrates a second embodiment of a compressed air injector according to this specification.

FIG. 13 schematically illustrates a second embodiment of a compressed air injector according to this specification. In the present embodiment, an electromagnetic valve 322 is further provided between the air nozzle 215 and the spiral tube 320. The other parts of the second embodiment are the same as the first embodiment.

The second embodiment of the compressed air injector illustrated in FIG. 13 corresponds to the configuration diagram of FIG. 7. More specifically, the electromagnetic valve 315 serves as the first electromagnetic valve, the electromagnetic valve 322 serves as the second electromagnetic valve, and the spiral tube 320 serves as the buffer unit. In the second embodiment, the pressure rapidly rises up at the beginning of air injection, as shown in FIG. 8(*a*). Thus, the leading edge of the sheet is effectively separated by air having a high pressure (flow rate).

In the second embodiment, the first electromagnetic valve 315 is previously opened in synchronization with passing of the sheet so that the spiral tube 320 (to the second electromagnetic valve 322) is filled with compressed air. The second electromagnetic valve 322 is opened immediately before the leading edge of the sheet reaches a vicinity of the nozzle 215 so that the air nozzle 215 starts injecting compressed air. Since the second electromagnetic valve 322 is connected to the air nozzle 215 by the hallow tube at a short distance of about 20 to 30 cm, the pressure rapidly rises up.

After termination of the air injection, the first electromagnetic valve 315 is closed while the second electromagnetic valve 322 is kept opened. Thus, the pressure (flow rate) gradually falls down in a similar manner as the first embodiment. After the compressed air filled in the spiral tube 320 (to the second electromagnetic valve 322) is naturally and gradually discharged due to flow path resistance of the air nozzle 215, the second electromagnetic valve 322 is closed according to the timing chart of FIG. 8(*b*) to be ready for the next printing operation.

Figure 14:
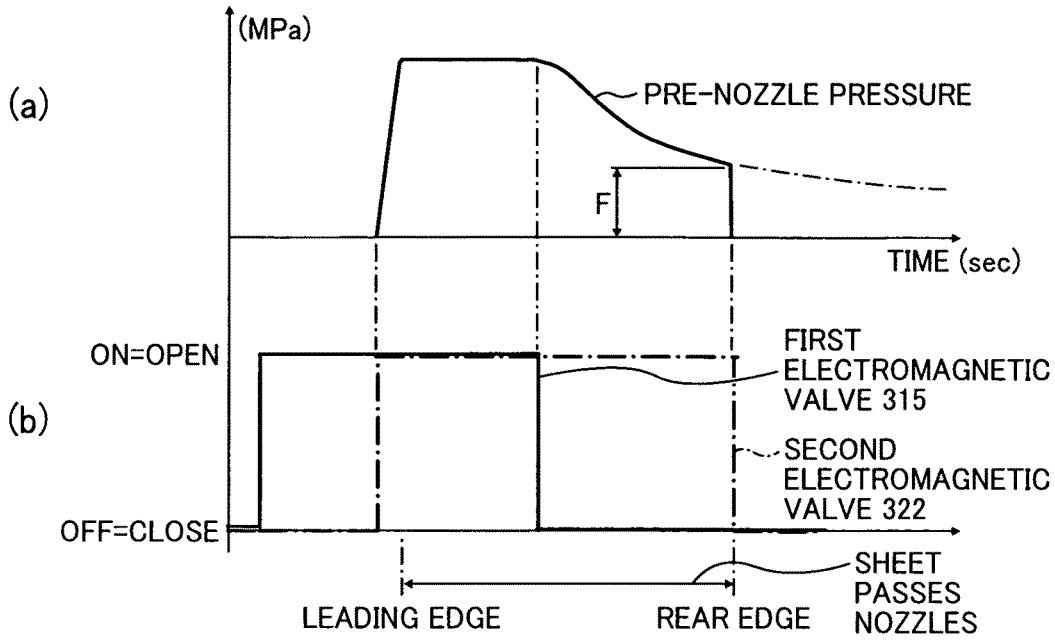
FIG. 14(*a*) and FIG. 14(*b*) are a graph showing injection pressure fluctuation and a timing chart for opening and closing the first electromagnetic valve and the second electromagnetic valve of the system illustrated in FIG. 13, respectively.

In the second embodiment, the pressure rapidly rises up at the beginning of air injection regardless of the volume of the spiral tube 320. Therefore, it is possible to adjust the length of the spiral tube 320 so that the spiral tube 320 has an enough large volume to keep the proper flow rate (pressure) from the nozzle even when a maximum-size sheet is passing. On the other hand, air is idly injected even after the rear edge of a small-size sheet has passed though the nozzles. Therefore, in the second embodiment, the second electromagnetic valve 322 is closed when the rear edge of the sheet has passed through a vicinity of the nozzle, as illustrated in a timing chart of FIG. 14(*b*). Although a residual pressure F remains within the spiral tube 320 as illustrated in FIG. 14(*a*), idle air injection can be stopped while the flow rate is gradually reduced. In continuous printing operation, the spiral tube 320 can be filled with compressed air within a much shorter time due to the residual pressure F compared to a case in which no residual pressure remains.

In both the first and second embodiments, after the sheet P passes through the fixing device 200, the compressor 301 is switched off and the electromagnetic valve 307 is switched on so that back pressure is discharged from the air filter 305 and the air tank 311 and drainage water is discharged to the evaporating dish 309. Thus, the pressure of the pneumatic piping is reduced to atmosphere pressure and the compressor 301 is ready for the next operation.

The time period during which the air flow rate falls down (shown by D in FIG. 5 and FIG. 6) varies depending on the buffer volume. However, it is difficult to arbitrarily change the buffer volume. When the sheet is short, the rear edge of the sheet passes through the nozzle within the time period D, so air is kept injected when the rear edge passes through the nozzle. By contrast, when the sheet is long, the rear edge of the sheet passes through the nozzle after termination of the time period D, so air is no longer injected when the rear edge passes through the nozzles. Therefore, in the latter case, the pressure Ps, required to separate the leading edge of a sheet, is maintained, but the pressure Pk, required after the leading edge is introduced into a paper feed guide, is reduced to zero on the way.

The above problem can be solved by lengthening the air injection time, i.e., the open time (for example, 0.1 seconds in FIG. 4) of the electromagnetic valve. In this case, however, air is kept injected at a high pressure of Ps, resulting in increase of the air flow rate. Such a high pressure above Pk wastes compressed air. Additionally, the compressor is needlessly made larger, and noise and cost rise are undesirably caused.

Figure 15:
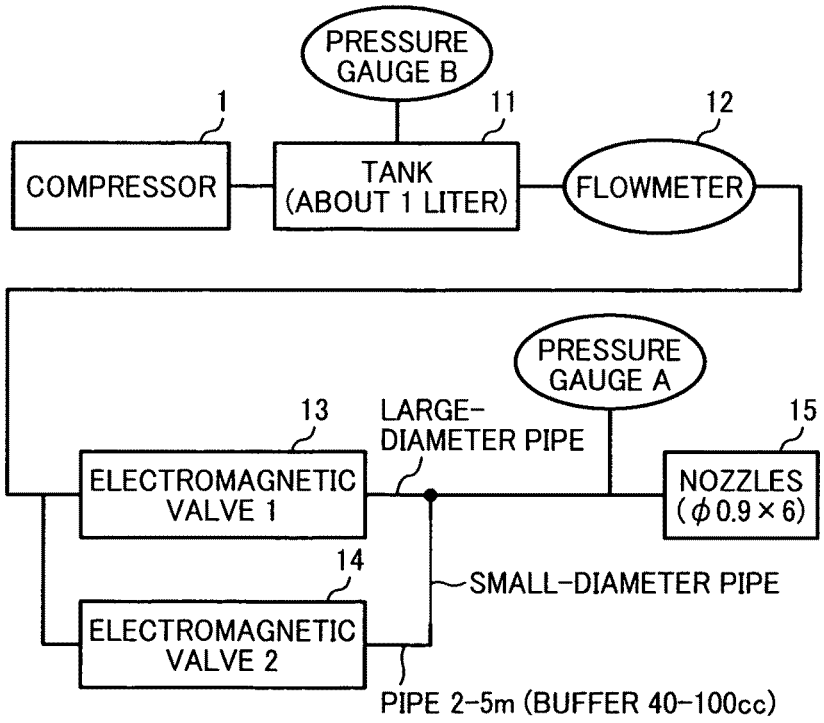
FIG. 15 is a configuration diagram of an air injection separation system similar to that illustrated in FIG. 3 in which a second electromagnetic valve is provided in parallel to the first electromagnetic valve.

To solve such problems, an air injection separation system having a configuration diagram illustrated in FIG. 15 is provided. In this system, the injection pressure is kept Pk even when the sheet is long, and is not rapidly reduced. Therefore, images having a difference in gloss are not produced.

In the configuration diagram of FIG. 15, the second electromagnetic valve 14 is connected in parallel to the first electromagnetic valve 13. Further, a buffer unit (e.g., a pipe) having a volume of 40 cc or more is provided upstream from the junction of the second electromagnetic valve 14 and the first electromagnetic valve 13. The buffer unit may be connected with the piping either in series or as a dead-end branch. At least one small-diameter pipe is provided upstream from the junction of the second electromagnetic valve 14 and a pipe connecting the first electromagnetic valve 13 and the nozzle 15. The cross-sectional area of the small-diameter pipe may be about half that of the pipe connecting the first electromagnetic valve 13 and the nozzle 15.

Immediately before the leading edge of the sheet reaches a vicinity of the nozzles (i.e., about 0.2 seconds after a sensor provided at the enter of the fixing nip detects the leading edge), the first and second electromagnetic valves 13 and 14 are simultaneously switched on (i.e., opened), and 0.1 seconds later, the first electromagnetic valve 13 is switched off (i.e., closed). While the first electromagnetic valve 13 is opened, air is injected at the pressure Ps, required to separate the leading edge of the sheet. Because the second electromagnetic valve 14 is kept opened even after the first electromagnetic valve 13 is closed, low-pressure air that is supplied from the small-diameter pipe is kept injected. The low-pressure air corresponds to the presser Pk, required after the leading edge is introduced into a paper feed guide. After the first electromagnetic valve 13 is closed, the injection pressure is gradually reduced to Pk owing to the buffer unit. Therefore, the resulting image has no difference in gloss. Immediately before (i.e., about 0.1 seconds before) the leading edge of the sheet gets out of the vicinity of the nozzles (i.e., about 0.5 seconds after a sensor provided at the entrance of the fixing nip detects the leading edge), the second electromagnetic valve 14 is switched off (i.e., closed).

Figure 16:
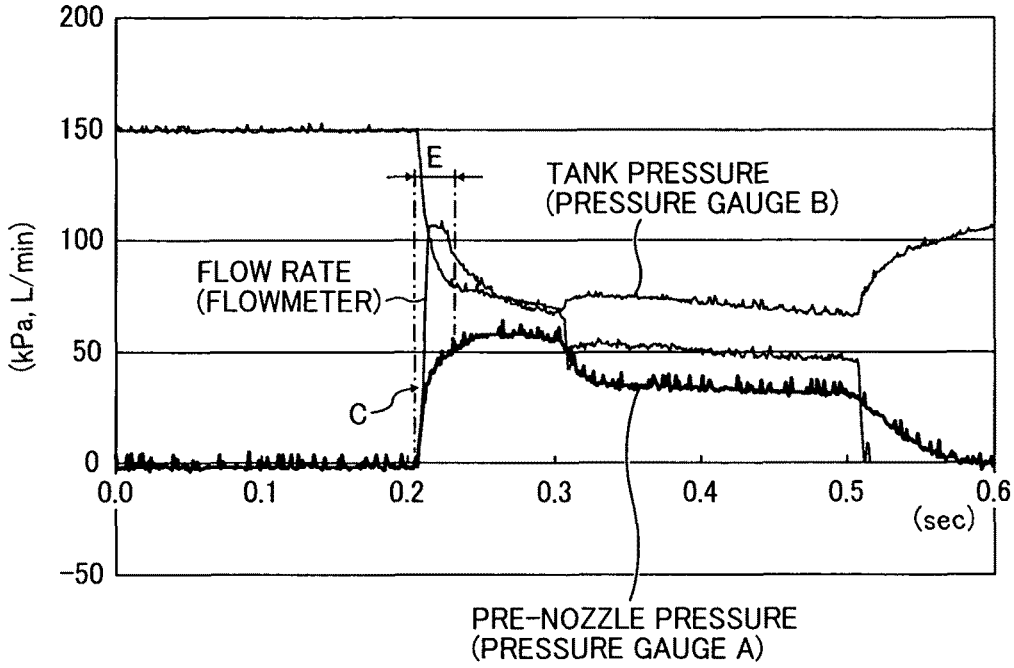
FIG. 16(*a*) and FIG. 16(*b*) are a graph showing injection pressure fluctuation and a timing chart for opening and closing the first electromagnetic valve and the second electromagnetic valve of the system illustrated in FIG. 15, respectively.
Figure 16:
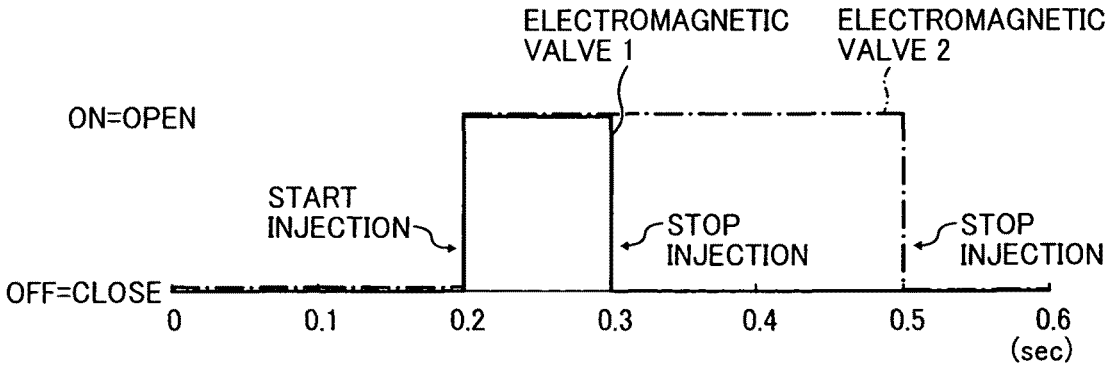

FIG. 16(*a*) is a graph showing injection pressure fluctuation of the system illustrated in FIG. 15. FIG. 16(*b*) is a timing chart for opening and closing the first electromagnetic valve 13 and the second electromagnetic valve 14. The compressed air accumulated in the buffer pipe having a volume of 40 to 100 cc is gradually discharged therefrom. Therefore, the pressure is gradually reduced to zero so as not to produce images having a difference in gloss.

JP-2007-86132-A discloses a configuration in which two electromagnetic valves are arranged in parallel, but no buffer unit is provided therein. Without buffer unit, it is difficult to gradually reduce the pressure and to prevent the occurrence of gloss difference in the resulting image.

In the configuration illustrated in FIG. 15, the injection pressure and flow rate can be gradually reduced over a period of time during which both a leading edge and a rear edge of a sheet pass the sheet separation part. On the other hand, rising up of the injection pressure also becomes more gradual, as illustrated in FIG. 16(*a*). As rising up of the injection pressure becomes more gradual, the time period (E) becomes longer and variation in the time period (E) becomes larger. As a result, the required pressure is obtained unreliably. To reliably separate the leading edge of the sheet, preferably, the injection pressure rapidly rises up as illustrated in FIG. 4.

Figure 17:
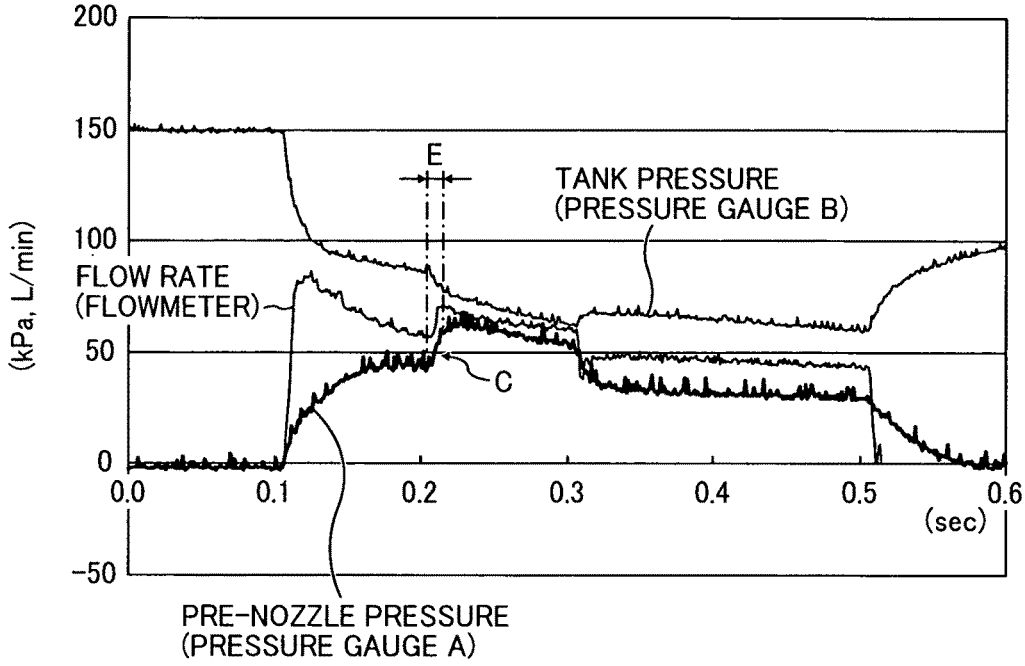
FIG. 17(*a*) and FIG. 17(*b*) are another graph showing injection pressure fluctuation and another timing chart for opening and closing the first electromagnetic valve and the second electromagnetic valve of the system illustrated in FIG. 15, respectively.
Figure 17:
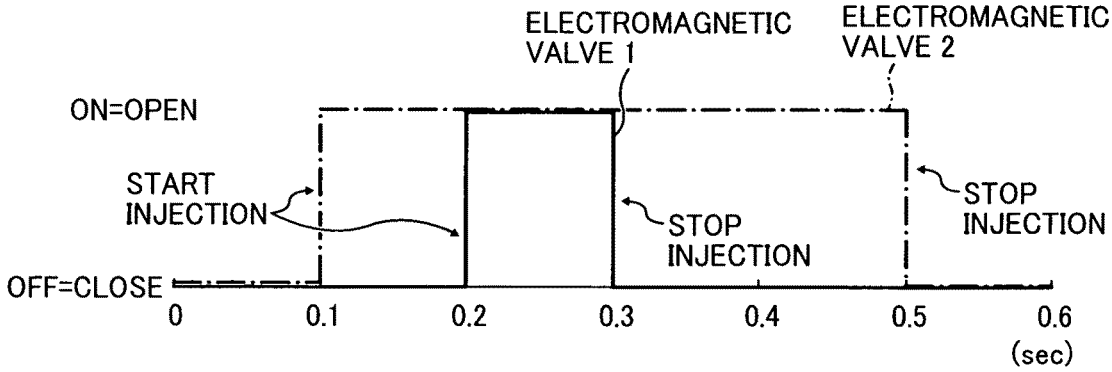

To make the injection pressure rapidly rise up and gradually fall down after terminating air injection, the configuration illustrated in FIG. 15 is preferably operated according to a timing chart illustrated in FIG. 17(*b*). FIG. 17(*a*) is a graph showing injection pressure fluctuation corresponding to FIG. 17(*b*). About 0.1 seconds after a sensor provided at the entrance of the fixing nip detects the leading edge of the sheet, the second electromagnetic valve 14 is switched on (i.e., opened), while the first electromagnetic valve 13 is kept switched off (i.e., closed). Before the leading edge reaches a vicinity of the nozzle, the buffer provided downstream from the second electromagnetic valve 14 is previously filled with compressed air having a low injection pressure (i.e., about 40 kPa in FIG. 17(*a*)). Because the buffer provided downstream from the second electromagnetic valve 14 is filled with compressed air, air does not escape to the buffer side. As a result, the pressure rapidly rises up upon opening of the first electromagnetic valve 13. Immediately before the leading edge of the sheet reaches the vicinity of the nozzles (i.e., about 0.2 seconds after a sensor provided at the entrance of the fixing nip detects the leading edge), the first electromagnetic valve 13 is switched on (i.e., opened). This timing of opening of the first electromagnetic valve 13 is the same as that in FIG. 16(*a*). Air is injected at a high pressure Ps to separate the leading edge of the sheet. In this embodiment, because the buffer is previously filled with compressed air having a low-pressure (corresponding to Pk), the injection pressure more easily reaches the high pressure Ps, compared to FIG. 16(*a*), within a short time period.

In this embodiment, the injection pressure rapidly rises up similar to the way shown by C in FIG. 4. Therefore, the above-described problem (i.e., as the time period (E) becomes longer, variation in the time period (E) becomes larger, and as a result, the required pressure is obtained unreliably) can be prevented. The rest of the injection operation is the same as FIG. 16(*b*). Thus; the produced image has no difference in gloss level.

The low injection pressure (i.e., about 40 kPa in FIG. 16(*a*), corresponding to Pk) varies depending on flow path resistance of the small-diameter pipe. The narrower the flow path, the lower the injection pressure. The wider the flow path, the higher the injection pressure. In a third embodiment to be described below, a flow rate control valve (serving as a small-diameter path) is connected to the piping in series so that the flow path resistance is controlled. With such a configuration, the injection pressure does not vary depending on apparatus and installation conditions.

Figure 18:
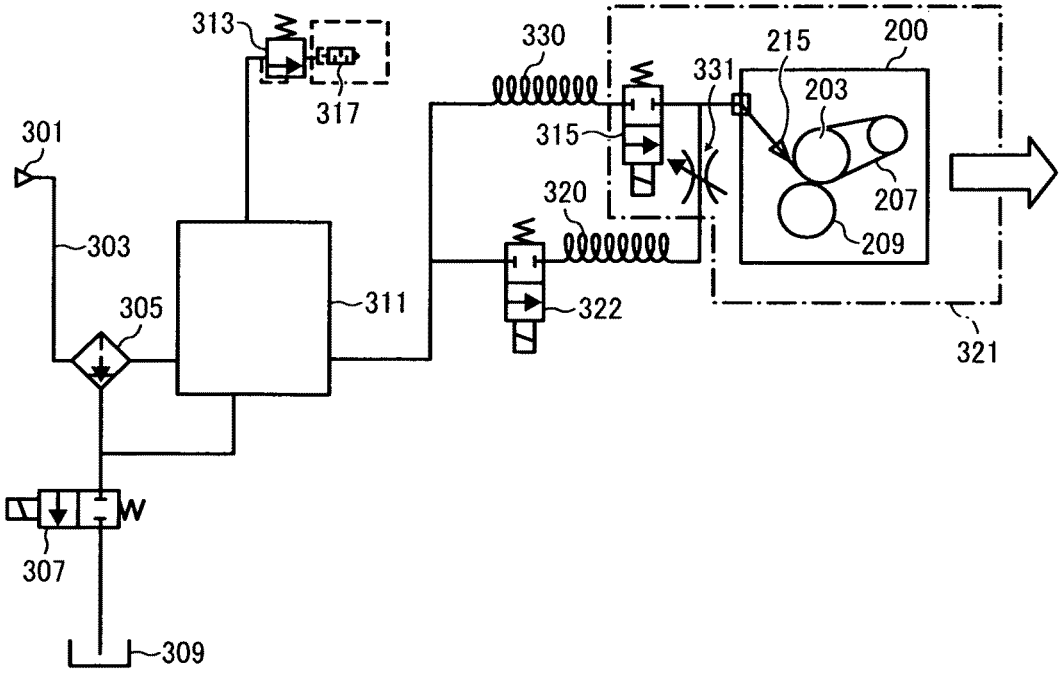
FIG. 18 schematically illustrates a third embodiment of a compressed air injector according to this specification.

FIG. 18 schematically illustrates a third embodiment of a compressed air injector according to this specification. The third embodiment of the compressed air injector illustrated in FIG. 18 corresponds to the configuration diagram of FIG. 15. More specifically, the electromagnetic valve 315 provided upstream from the nozzle 215 serves as the first electromagnetic valve, and the electromagnetic valve 322 connected in parallel to the first electromagnetic valve 315 serves as the second electromagnetic valve. A buffer unit (i.e., the spiral tube 320) is provided upstream from the junction of the second electromagnetic valve 332 and the first electromagnetic valve 315. Further, a flow rate control valve 331 serving as the small-diameter path is provided between the spiral tube 320 and the junction. In the third embodiment, the injection pressure and flow rate gradually fall down over a period of time during which both a leading edge and a rear edge of a sheet pass the sheet separation part, even when the sheet is long. Additionally, the pressure rapidly rises up at the beginning of air injection. Thus, the leading edge of the sheet is effectively separated by air having a high pressure (flow rate). A buffer unit (i.e., a spiral tube 330) is further provided upstream from the first electromagnetic valve 315.

Injection control and injection pressure fluctuation are the same as explained in FIG. 17(*a*) and FIG. 17(*b*). First, the second electromagnetic valve 322 is switched on (i.e., opened) while the first electromagnetic valve 315 is kept switched off (i.e., closed). Immediately before the leading edge of the sheet reaches a vicinity of the nozzles 20. (i.e., about 0.2 seconds after a sensor provided at the entrance of the fixing nip detects the leading edge), the first electromagnetic valve 315 is switched on (i.e., opened). Thus, the injection pressure rapidly rises up (shown by C in FIG. 17(*a*)) within a short time period (shown by E in FIG. 17(*a*)).

Immediately after (i.e., 0.1 seconds after) the first electromagnetic valve 315 is opened, the first electromagnetic valve 315 is closed so as not to waste compressed air. Even after the first electromagnetic valve 315 is closed, the second electromagnetic valve 322 is kept opened so that low-pressure air is injected until the rear edge of the sheet passes through the nozzle. When the rear edge of the sheet gets out of the vicinity of the nozzle may be determined based on the size of the sheet or detection results of the entrance sensor.

After the sheet P passes through the fixing device 200, the compressor 301 is switched off and the electromagnetic valve 307 is switched on so that back pressure is discharged from the air filter 305 and the air tank 311, and drainage water is discharged to the evaporating dish 309. Thus, the pressure of the pneumatic piping is reduced to atmosphere pressure and the compressor 301 is ready for the next operation.

In the third embodiment, an optimum injection pressure can be obtained by controlling the flow rate control valve 331 regardless of apparatus conditions. Preferably, the flow rate control valve 331 is an electric proportional control valve that electrically controls air flow rate (i.e., injection pressure) according to paper kind or environmental condition even in the middle of image forming operation.

Additional modifications and variations of the present invention are possible in light of the above teachings. It is therefore to be understood that within the scope of the appended claims the invention may be practiced other than as specifically described herein. For example, the volume of the buffer unit may be arbitrarily set according to configuration of the pneumatic circuit. The buffer unit is not necessarily comprised of a spiral tube, and may have a configuration which can store compressed air, for example, an air tank. The electromagnetic valves, serving as switching units, are not limited to have any specific configuration. The switching units are not necessarily comprised of electromagnetic valves, and may be comprised of cams, for example. The shape, number, and interval distance of the nozzles are also arbitrarily set considering separation performance.

The fixing device is not limited to that equipped with an internal heater contained in a roller. The roller may be externally heated. Alternatively, induction heating is also applicable. The fixing device is not limited to that employing a fixing belt, and may be that employing a heating roller.

The image forming apparatus is not limited to that employing a tandem image forming method. The image forming apparatus is not limited to that employing an intermediate transfer method. For example, direct transfer methods are applicable. The image forming apparatus may produce any of full-color, two-color, and single-color images. The image forming apparatus may be a copier, a printer, a facsimile, or a combined machine having multiple functions.

What is claimed is:

1. An image forming apparatus, comprising:

a fixing device to fix a toner image on a recoding medium;

a compressed air generator to generate a compressed air;

an air nozzle to inject the compressed air to separate the recording medium having the fixed toner image from the fixing device;

a first switching unit to switch the air nozzle between injection and termination, the first switching unit being provided upstream from the air nozzle; and a buffer unit to retain the compressed air, the buffer unit being provided upstream from the air nozzle and downstream from the first switching unit, wherein the buffer unit is an extendable piping that connects the air nozzle and the first switching unit, and wherein the fixing device and the air nozzle are included in a fixing unit, the fixing unit is configured to be drawn out of the image forming apparatus while connecting to the buffer unit.

2. The image forming apparatus according to claim 1, wherein the air nozzle has an injection outlet having an area of 1 $mm^2$ or less.

3. An image forming apparatus, comprising:

a fixing device to fix a toner image on a recoding medium;

a compressed air generator to generate a compressed air;

an air nozzle to inject the compressed air to separate the recording medium having the fixed toner image from the fixing device;

a first switching unit to switch the air nozzle between injection and termination, the first switching unit being provided upstream from the air nozzle;

a buffer unit to retain the compressed air, the buffer unit being provided upstream from the air nozzle and downstream from the first switching unit; and a second switching unit provided upstream from the air nozzle and downstream from the buffer unit, wherein the air nozzle injects the compressed air when the second switching unit is opened, and terminates when the first switching unit is closed.

4. The image forming apparatus according to claim 1, wherein the extendable piping is a spiral tube.

5. The image forming apparatus according to claim 1, further comprising a second switching unit provided upstream from the air nozzle and downstream from the buffer unit, wherein the air nozzle injects the compressed air when the second switching unit is opened, and terminates when the first switching unit is closed.

6. The image forming apparatus according to claim 5, wherein the second switching unit is closed after a rear edge of the recording medium passes through the air nozzle.

7. The image forming apparatus according to claim 5, wherein at least one of the first switching unit and the second switching unit is an electromagnetic valve.

8. The image forming apparatus according to claim 7, wherein the second switching unit is closed after a rear edge of the recording medium passes through the air nozzle.

9. The image forming apparatus according to claim 1, further comprising a second switching unit provided in parallel to the first switching unit, wherein the buffer unit is provided upstream from the air nozzle and downstream from the second switching unit.

10. The image forming apparatus according to claim 9, further comprising a small-diameter path provided downstream from the buffer unit and upstream from a junction with a flow path that connects the first switching unit and the air nozzle, the small-diameter path having a narrower cross-sectional area than that of said flow path.

11. The image forming apparatus according to claim 10, wherein the small-diameter path is comprised of a flow rate control valve.

12. The image forming apparatus according to claim 11, wherein the flow rate control valve is an electric proportional control valve.

13. The image forming apparatus according to claim 9, wherein the first switching unit is opened while a leading edge of the recording medium passes through the air nozzle, and the second switching unit is opened while the leading edge and a rear edge of the recording medium passes through the air nozzle.

14. The image forming apparatus according to claim 13, wherein the second switching unit is opened earlier than the first switching unit is opened.

15. The image forming apparatus according to claim 3, wherein the buffer unit is comprised of a piping that connects the air nozzle and the first switching unit.

16. An image forming apparatus, comprising:

a fixing device to fix a toner image on a recoding medium;

a compressed air generator to generate a compressed air;

an air nozzle to inject the compressed air to separate the recording medium having the fixed toner image from the fixing device;

a first switching unit to switch the air nozzle between injection and termination, the first switching unit being provided upstream from the air nozzle;

a buffer unit to retain the compressed air, the buffer unit being provided upstream from the air nozzle and downstream from the first switching unit;

a second switching unit provided in parallel to the first switching unit, wherein the buffer unit is provided upstream from the air nozzle and downstream from the second switching unit; and a small-diameter path provided downstream from the buffer unit and upstream from a junction with a flow path that connects the first switching unit and the air nozzle, the small-diameter path having a narrower cross-sectional area than that of said flow path.

17. The image forming apparatus according to claim 16, wherein the small-diameter path is comprised of a flow rate control valve.

18. The image forming apparatus according to claim 17, wherein the flow rate control valve is an electric proportional control valve.

19. An image forming apparatus, comprising:

a fixing device to fix a toner image on a recoding medium;

a compressed air generator to generate a compressed air;

an air nozzle to inject the compressed air to separate the recording medium having the fixed toner image from the fixing device;

a first switching unit to switch the air nozzle between injection and termination, the first switching unit being provided upstream from the air nozzle;

a buffer unit to retain the compressed air, the buffer unit being provided upstream from the air nozzle and downstream from the first switching unit; and a second switching unit provided in parallel to the first switching unit, wherein the buffer unit is provided upstream from the air nozzle and downstream from the second switching unit, wherein the first switching unit is opened while a leading edge of the recording medium passes through the air nozzle, the second switching unit is opened while the leading edge and a rear edge of the recording medium passes through the air nozzle, and wherein the second switching unit is opened earlier than the first switching unit is opened.

* * * * *